US005873708A

United States Patent [19]

Delhomme, II et al.

[11] Patent Number: 5,873,708

[45] Date of Patent: Feb. 23, 1999

[54] OIL-FREE COMPRESSOR USING SPECIAL GEARING ASSEMBLY BETWEEN ENGINE AND COMPRESSOR

[75] Inventors: Alfred J. Delhomme, II, New Iberia, La.; Tim Henderson, Dunbartonshire, United Kingdom; Robert McGregor, Glasgow; Alan White, Renfrenshire, both of Scotland; Thomas Sreeves, Dunbartonshire, United Kingdom; Hale Boudreaux, Jeangrette, La.

[73] Assignee: Aggreko, Inc., New Iberia, La.

[21] Appl. No.: 685,234

[22] Filed: Jul. 23, 1996

[51] Int. Cl.[6] ..... F04B 17/00; F04B 39/00

[52] U.S. Cl. ..... 417/312; 417/313; 417/234; 417/364; 181/204

[58] Field of Search ..... 417/364, 312, 417/313, 234; 181/200, 202, 204

[56] References Cited

U.S. PATENT DOCUMENTS

| | | | |
|---|---|---|---|
| 3,478,958 | 11/1969 | Hinck, III et al. | 181/200 |
| 3,612,213 | 10/1971 | Piko | 181/200 |
| 3,815,965 | 6/1974 | Ostwald | 181/204 |
| 3,856,439 | 12/1974 | Moehrbach | 417/364 |
| 4,022,550 | 5/1977 | Brink et al. | 417/312 |
| 4,077,383 | 3/1978 | Hatz | 181/200 |
| 4,733,750 | 3/1988 | Poirier et al. | 181/200 |
| 4,844,701 | 7/1989 | Wolford et al. | 417/312 |
| 5,297,517 | 3/1994 | Braudt et al. | 181/204 |

FOREIGN PATENT DOCUMENTS

| | | | |
|---|---|---|---|
| 2420043 | 11/1979 | France | 417/364 |

*Primary Examiner*—Charles G. Freay
*Attorney, Agent, or Firm*—Fish & Richardson P.C.

[57] ABSTRACT

An oil free compressor uses special structure to interface the engine and compressor. Special quieting structure is also disclosed, including an upward exhaust mechanism, to maintain quiet operation.

18 Claims, 5 Drawing Sheets

OIL-FREE COMPRESSOR USING SPECIAL GEARING ASSEMBLY BETWEEN ENGINE AND COMPRESSOR

FIELD OF THE INVENTION

The present invention relates to an oil-free high volume compressor assembly which has reduced noise and improved operating characteristics.

BACKGROUND AND SUMMARY OF THE INVENTION

Air compressors, and specifically high powered air compressors, have well-deserved reputations as oily, dirty and noisy devices. Such compressors often produce large quantities of waste oil in many locations, including in the stream of air that is output from the unit. They have been very loud when operating.

An oil-free output tip for such a compressor has been developed. This device produces an oil-free output; however, this oil-free tip has special requirements. The oil-free tip often requires a relatively high rpm from the driving prime mover. Engines which drive conventional compressor tips often run at 1800 to 2100 rpm. One example of such an engine is made by Kobelko. However, the oil-free tips have often required 3000 or 4000 rpm.

Previous attempts to change the rotational speed of these engines using gears have met with problems. Unexpectedly, many of these attempts at gearing simply did not work, and the inventors found many problems that existed in this gearing. Those problems, and their solutions, are among the objects of the present invention.

Many such compressors, moreover use very loud, noisy prime movers. The inventors also found that the users of these compressors do not want a very noisy or dirty compressor.

Commercial scale compressors of this type operate at extremely high energy levels. The inventors found that any variation in the output of the motor causes extremely difficult problems with balancing and tuning.

It is an object of the present invention to avoid the above-described problems, by providing an oil-free compressor which includes special noise and vibration reducing characteristics.

BRIEF DESCRIPTION OF THE DRAWINGS

These and other aspects of the invention will now be described in detail with reference to the accompanying drawings, wherein.

DESCRIPTION OF THE PREFERRED EMBODIMENT

The preferred embodiment of the invention relates to an oil-free compressor tip and engine which is mounted on a special support mechanism along with its special mechanisms for noise reduction. The mounting and operation is specially modified to take advantage of the special needs of this oil-free compressor.

The support mechanism includes special supports which prevent any harmonic imbalance. As described herein, this support mechanism also includes special elements which minimize noise. The present invention also defines special techniques that the inventors found enable better mounting of this device.

The high speed and power operation of the device requires that the mounting be precisely and carefully controlled. This precise and careful control is extremely important according to the present invention.

Figure 1:
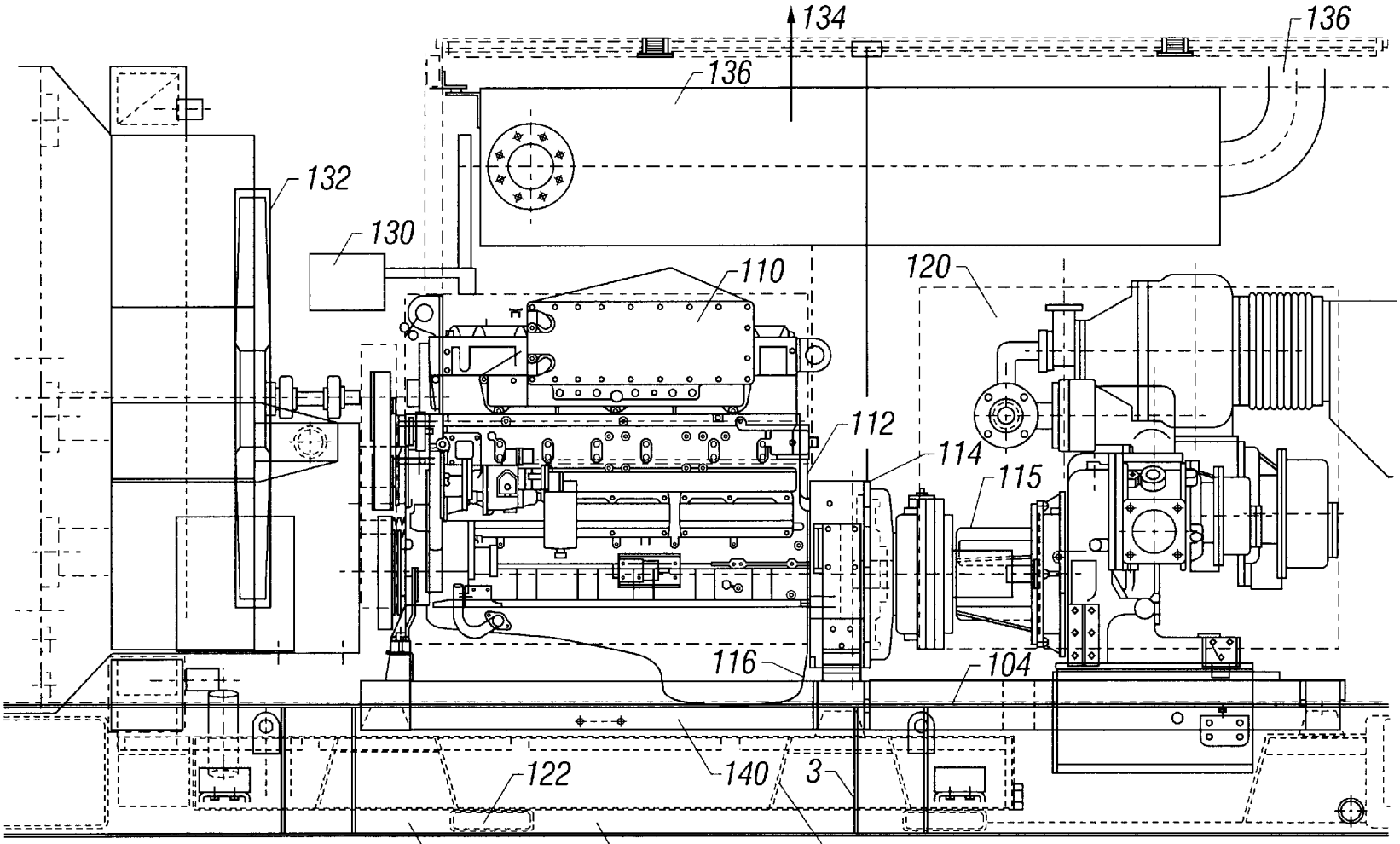
FIG. 1 shows a cross sectional detail of the engine and compressor as mounted according to the present invention.
Figure 1A:
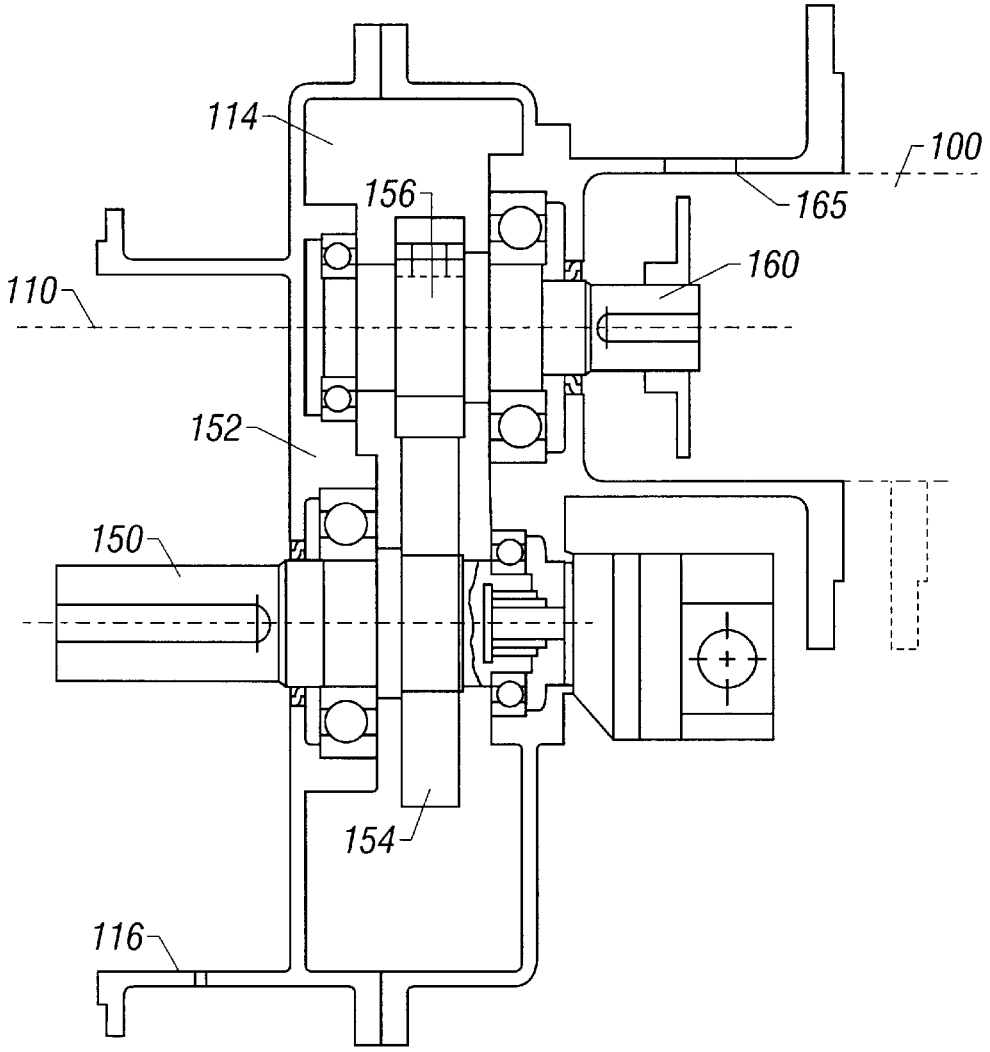
FIG. 1A shows a detail of the preferred gearbox used according to the present invention.

The overall compressor mounted unit is shown in cross-section in FIG. 1. Frame 102 is formed of reinforced steel materials, e.g. ¼ rolled steel. The reinforced materials include an attachment section 104, which includes surfaces attaching to all of the unit elements. These attached elements include at least the engine 110, the compressor 120, and the gearing unit 114. The output 112 of the engine includes a gearing mechanism 114 which increases the engine RPM by about a 1:1.7 ratio. A special low noise and low vibration gearing system described herein is used for this purpose.

The gearing element 114 includes a first side 115 with an output surface which is a REXNORD coupling press-fit on to the end of compressor 120. The second side of the gear unit 114 is attached by a flexing structure, e.g., soft rubber connections to the output surface of the engine 110. One important feature of the present invention is the way in which the compressor and engine are connected to one another. The inventors found that very large stress is created during operation of this system. These stresses inevitably create movement in the most carefully and securely mounted engines. Accordingly, the present invention preferably forms the system without a rigid connection between the engine and compressor. Only one end is rigidly connected; the other end is press fit and allowed to move. This allows movement between the engine and the compressor tip. The gear is rigidly connected to one of the engine or compressor, and connected to the other of the engine or compressor in a non-rigid way. This allows some movement between the engine and compressor without bending or deforming some metal to metal connection.

A detailed structural diagram of the gearing unit as attached to the engine and compressor is shown in FIG. 1. The diagram shows the gearbox 114 coupled between the engine shaft 150 on the engine side 110. The other end of gearbox 114 is on the compressor side 120. Engine 110 rotates to transmit force from the rotation to gear assembly 152. The gear assembly 152 includes a first gearing part 154 attached to engine shaft 150, and a second gearing part 156 attached to compressor side shaft 160. Press fit surfaces 165 are press fit around the outside of the compressor end, to maintain a tight connection therebetween. The press-fit element is also bolted on.

When the inventors first operated this system, they began by simply placing the gear mechanism 114 between the engine 110 and the compressor 120. They found, however, that the forces created by this operation, and especially the harmonic forces, caused significant problems. Many of the first prototypes that were made were actually destroyed when operated. The inventors solved these problems by certain stiffening of the mounting mechanism 102 and also by careful attachment of the gear casing at 116 to the mounting mechanism. Offset gear elements also allow a certain amount of flexing, and the special flexing structure which are described herein facilitate this flexure.

The compressor mounting mechanism may include inner surfaces 122 which allows the entire connected unit to be picked up by a forklift or other truck mounted connecting element.

The system includes a large number of high-speed and high-stress operating components. The inventors realized that compressor operation and exhaust of cooling air carries much noise. One of the low noise operations of the present invention exhausts all air in an upward direction. This was found to exhaust the noise upwards also. This directional exhaust of air was found to be less bothersome to the user.

The air for cooling the compressor is input through an air intake fan 132 through a noise reducing louver and noise element. The louver preferably includes tilted air deflection elements and a noise filtering material therein. The air that is forced inwards is exhausted upwards through canopy area 134.

Oil pump 130 produces oil under pressure for use by gear box and compressor components. This oil under pressure is also applied to pressurize canopy pistons 318 and 320, and hence open the canopy as described herein. Hence, a failure of oil, which can cause many problems, will also cause visual and audial indications: the canopy will close. By closing, the fan will be overloaded, and will cause an unusual noise.

Figure 2A:
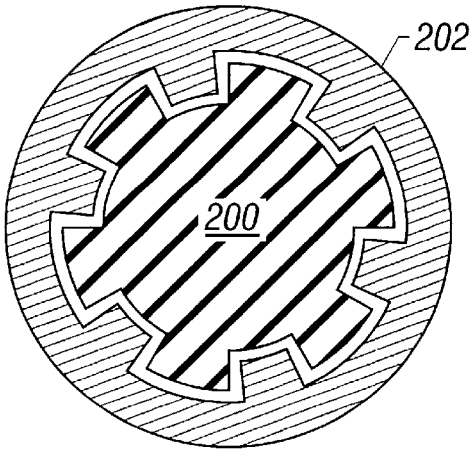
FIG. 2 shows a detailed drawing of the gearing used according to the present invention.
Figure 2B:
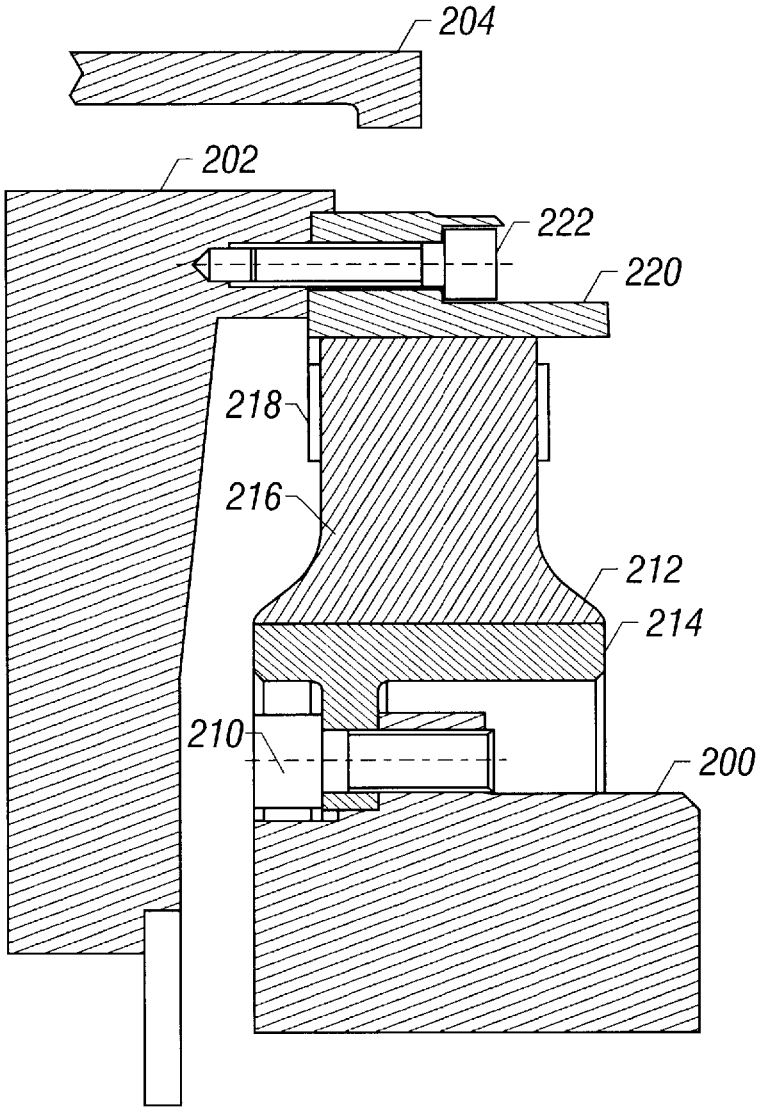

FIG. 2 shows a detail of the gearing attachment system used according to the present invention. The system is conceptually formed of a gear box shaft 200, and a flywheel 202. The object of the attachment system is to connect the flywheel to the gear box shaft. The flywheel 202 connects to the crank shaft of the engine. As previously discussed, the flywheel housing 204 forms a bell which is connected to other housing parts to hold the flywheel assembly in its proper place.

Gearbox shaft 200 is connected to the gear box, and provides the output power to the gear box. The gearbox shaft 200 includes bolt 210 which holds the gear box shaft onto the assembly piece 212. The assembly piece 212 includes a rubber interface plate 214, a donut shaped rubber plate 216, rubber connector 218, and an iron attachment piece 220. The attachment piece 220 is bolted into the flywheel 202 using bolts 222.

In operation, the gear box rotates based on power supplied from the flywheel 202.

An important feature of this aspect of the present invention is that much of the vibration caused by the rotation is absorbed by the rubber elements 216. This helps silence the operation, but also avoids much of the otherwise possibly harmful vibration which could be caused.

The output noise of the engine is further silenced by muffler 136 which exhausts upward through exit element 138.

The device main frame 102 includes a lower frame support portion 115 and a connecting portion 140, by which the engine, compressor, and gear box are supported. Connecting braces 118 connect between the lower portion 115 and the connecting portion. Outer walls are also formed as a housing for the device.

Figure 3:
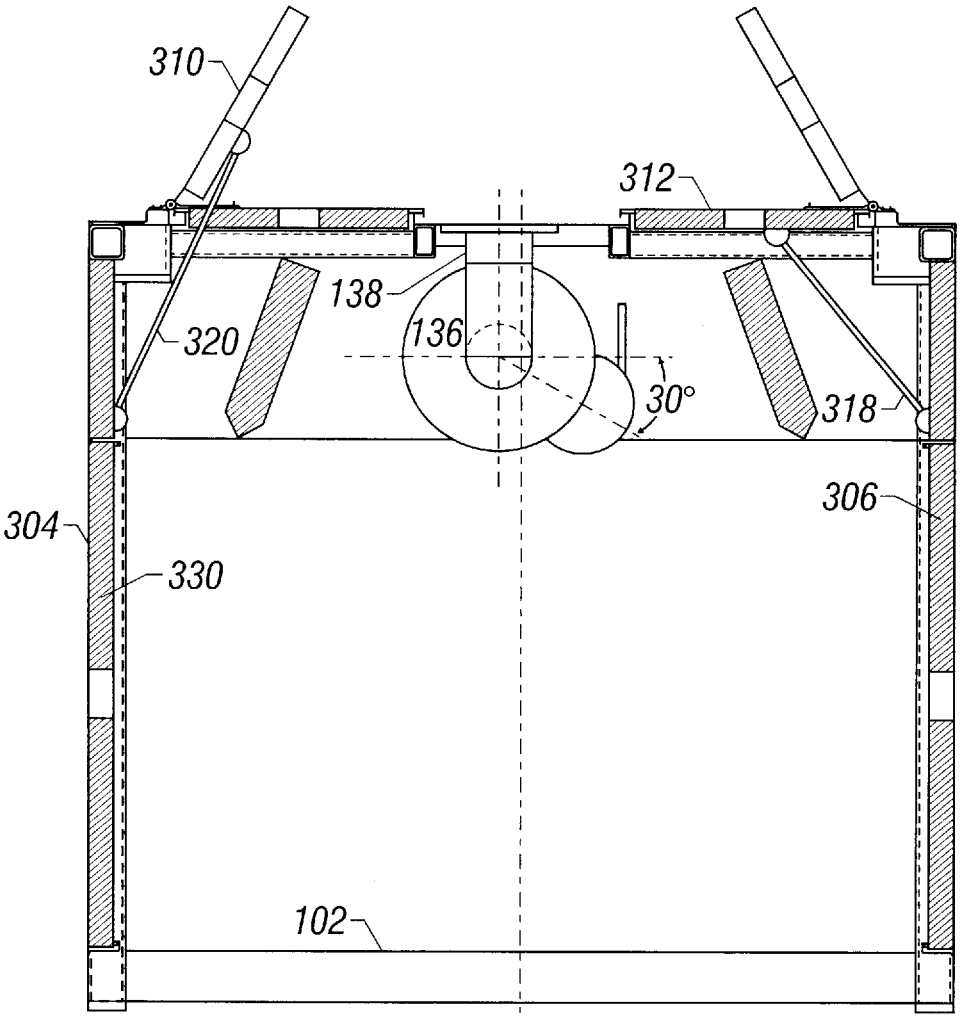
FIG. 3 shows a cross section of the device along the line 3—3 in FIG. 1.

FIG. 3 shows a cross section of the unit along the line 3—3 in FIG. 1. Side walls 304, 306 form the sides for the cavity enclosed by the unit. The walls 304, 306 also include soundproofing insulation 330 therein. Top walls for the unit are formed with openable louvers 310, 312. The bottom portion of the housing is also sealed. This forms a sealed housing where the air can only be exhausted upward through the openable louvers.

Each of the louvers is attached to a hydraulic oil-driven cylinder. The oil-driven cylinder 318 is in its minimum size position. In this position, the weight of louver holds down the louver in its closed position shown in 312. Both oil cylinders, however, are connected to oil pump 130, which supplies the operating oil for the unit's moving parts. Pressurization of oil by pump 130 expands the hydraulic cylinder to the position shown in by the amount shown in 320. This expansion overcomes the weight of the louver and presses it upward to the position shown as 310. In this position, the top is open and the pressurized air can be exhausted upward through the open louvers.

It should be understood that in normal operation there could not be one closed louver and one louver as FIG. 3 shows.

FIG. 3 also shows the muffler unit 136, and its upward exhausting element 138. The location of the upward exhaust is preferably between the louvers.

The inventors found that the sound of the unit of the present invention falls into different types many of which are silenced by the system of the present invention. Combustion noise is produced by the operation of the engine, e.g., the explosions caused by combustion of the fuel. The compressor also makes certain noise, "compressor noise". A first part of this noise is carried by the combustion air. This part is quieted both by the muffler, and by exhausting upwards. A second part of the combustion noise is conducted by the steel engine case. This is quieted by the wall insulation, and the flow of air upward which convects the noise upward. A third noise is fan noise for the fan that intakes the cooling air. This noise is quieted by the wall and louver insulations, and by exhausting upward.

This combination of quieting elements produces substantially quieter operation than is possible in the prior art.

All of this is provided to minimize the amount and kinds of sound from reaching the user. Since these devices are typically truck-mounted, the walls are typically at the level of the users' ears. By exhausting the sound upward, the amount of sound that is heard can be minimized.

Figure 4:
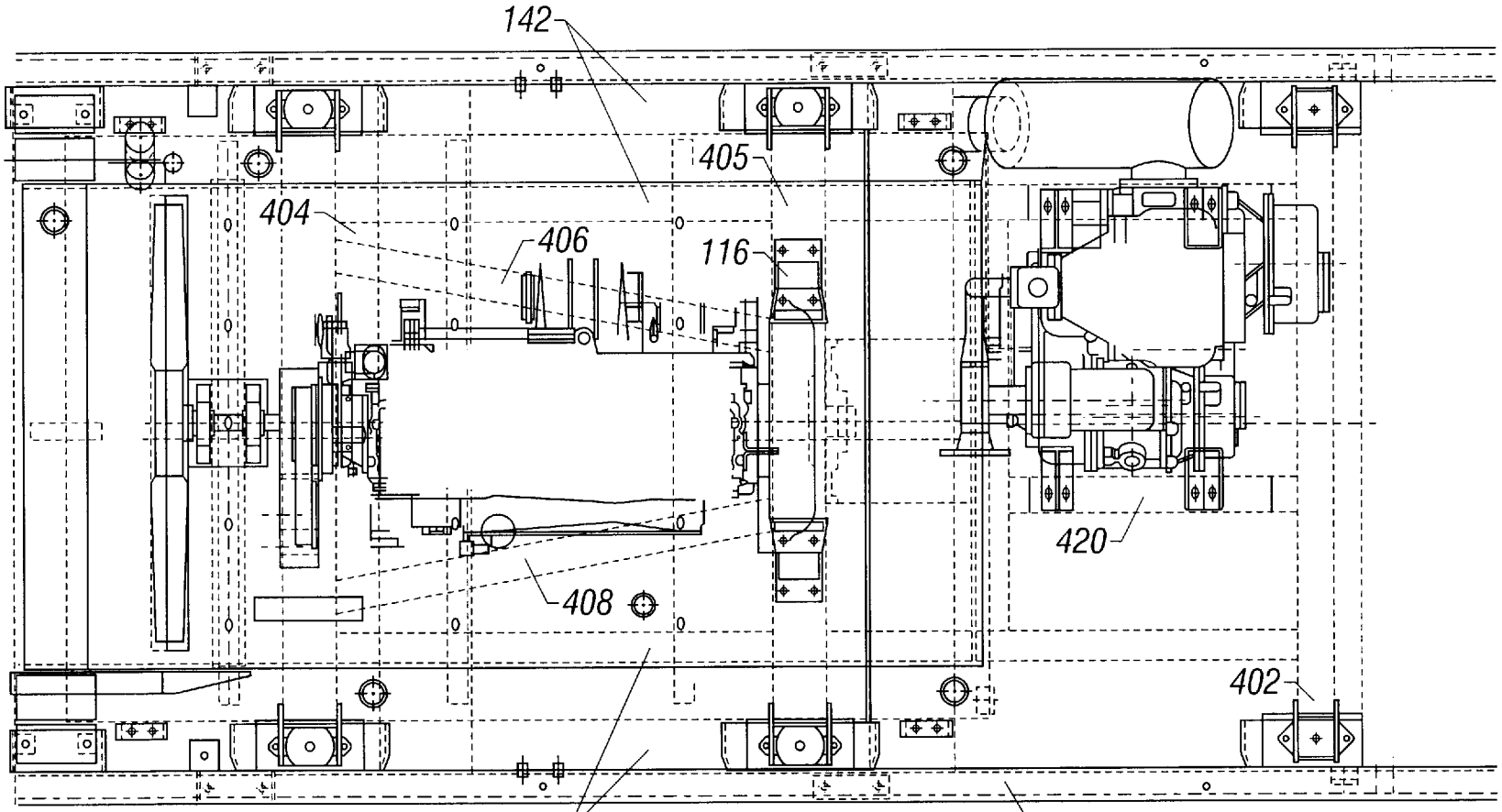
FIG. 4 shows a top view of the unit of the present invention.

The bracing of the present invention is extremely important. FIG. 4 shows a top detail of the bracing. The overall housing has a rectangular outer shape of the case for the air compressor assembly. The rectangular case has four insulated walls. However, access panel hatches such as 400 are provided. The long axis of the rectangle includes a first set of supports 140. The first set of supports include first support 140 and second support 142. These supports are connected directly to the casing element.

Also connected to that casing element, and between the first set of supports, are longitudinal supports which extend along the short axis of the case. Supports such as 402 extend between the supports 140 and 142 in a direction substantially orthogonal to the supports 140 and 142, to thus further brace the elements. Extra support elements 406 and 408 extend substantially diagonally between the longitudinal supports 406, 405. These diagonal supports provide an additional measure of flex resistance. The usual support members provide support against most kinds of movement. However, the inventors of the present invention found that even slight amounts of movement by the engine can cause undesirable harmonic imbalances. The special diagonal members support between the front and rear of the motor, and prevent many of the otherwise possible motions. Engine 110 is mounted to the frame in various locations. The gear box, moreover, is also securely mounted to the frame at 116.

The compressor is similarly mounted to frame elements 420 421.

The long axes of the element may include access covers therein, which enable the device to be opened to secure access thereto. However, the bottom of the housing is preferably totally sealed. The only air intake is through one of the sidewalls, and being exhausted though the top. Sealing the bottom helps not only with noise, for also with cleanliness of the area surrounding the unit by minimizing the amount of oil that is. This has the tendency to make the ground underneath the compressor become very dirty.

Although only a few embodiments have been described in detail above, those having ordinary skill in the art will certainly understand that many modifications are possible in the preferred embodiment without departing from the teachings thereof. For example, while the intake for the cooling air has been recited as being intake from the sidewalls, it could also be intake from the bottom, for example.

All such modifications are intended to be encompassed within the following claims.

What is claimed is:

1. An oil-free compressor assembly, comprising:

a housing for the compressor, said housing including a lower frame defining a bottom portion of the housing, of a substantially rectangular shape, four side walls defining the rectangular shape of the housing, and a top portion, said bottom portion of the housing defining a fluid tight area, underneath said frame, said side walls including soundproofing elements thereon, and said top portion including an openable canopy, whereby sound is exhausted through the top portion only during normal operation, said frame including mounting sections therein;

an engine, mounted to one of said mounting sections of said frame, at least at front and rear portions thereof;

a compressor, mounted to said mounting section; and a gearing assembly, coupled between said engine and said compressor.

2. An oil-free compressor assembly, comprising:

a housing including a lower frame defining a bottom portion of the housing, side walls, and an upper area;

an engine;

a gearing element, connected to said engine;

a compressor, coupled to said gearing element to receive driving power from rotation of said engine;

at least one-of said engine and said compressor being rigidly mounted to said frame, and the other of said engine and compressor being loosely mounted to said frame to allow movement of said other relative to said frame; and at least one noise reduction element, coupled to said housing.

3. An oil free compressor assembly as in claim 2, wherein said engine is rigidly mounted to the frame, and said compressor is press-fit to the engine.

4. A compressor as in claim 3 wherein said gearing element includes flexing structure therein which allows said compressor to flex in direction-relative to said engine.

5. A compressor as in claim 3, wherein the engine includes output surfaces, and the gearing element includes matching output surfaces which allow a press fit connection to the output surfaces of the engine.

6. A compressor as in claim 3, wherein said noise reduction element comprises an upward-exhaust mechanism, which causes all waste air from the device to be exhausted in an upward direction.

7. A compressor as in claim 6, further comprising a noise reducing louver including tilted air deflection elements and a noise filtering material therein, and a fan drawing air inward through said louver, and outward through said upward direction.

8. A compressor as in claim 6, further comprising an oil pump, producing a pressurized flow of oil, and wherein said housing further comprises a hinged element, which is normally closed, and which is movable to an upward position where it allows air to exhaust upwardly, said hinged element including a piston which is driven by said pressurized flow of oil.

9. An oil-free compressor assembly, comprising:

a housing for the compressor, said housing including a lower frame defining a bottom portion of the housing, four side walls, each connected to said bottom portion, said bottom portion of the housing defining a fluid tight area, said side walls including inner surfaces with soundproofing elements thereon, and at least one of said bottom portion and sidewalls including an air opening with an air louver, said housing also including a movable top portion which is movable between a normally closed position, and an openable position;

an engine, mounted to one of said mounting sections of said frame, at least at front and back portions thereof, a compressor, mounted to said housing;

an engine, mounted to one of said mounting sections of said frame, at least at front and back portions thereof, an oil pump, producing pressurized oil for said engine;

an opener for said top portion, driven to open said top portion based on said pressurized oil; and an air exhaust fan, drawing air in through said air opening and exhausting said air only through said top portion.

10. An oil-free compressor assembly, comprising:

a housing including a lower frame defining a bottom portion of the housing, side walls, and an upper area;

an engine;

a gearing element, connected to said engine;

a compressor, coupled to said gearing element to receive driving power from rotation of said engine;

said engine and said compressor being non-rigidly connected to one another in a way such that angular movement between said engine and said compressor is permitted; and at least one noise reduction element, coupled to said housing.

11. A compressor as in claim 10, wherein said gearing element includes a flexible element therein.

12. A compressor as in claim 11, wherein said noise reduction element comprises an upward-exhaust mechanism, which causes all waste air from the device to be exhausted in an upward direction.

13. A compressor as in claim 12, further comprising a noise reducing louver including tilted air deflection elements and a noise filtering material therein, and a fan drawing air inward through said louver, and outward through said upward direction.

14. A compressor as in claim 13, further comprising an oil pump, producing a pressurized flow of oil, and wherein said housing further comprises a hinged element, which is normally closed, and which is movable to an upward position where it allows air to exhaust upwardly, said hinged element including a piston which is driven by said pressurized flow of oil.

15. An oil-free compressor assembly, comprising:

a housing for the compressor, said housing including a frame defining a bottom portion of the housing, side walls defining outer portions of the housing, and a top portion, said bottom portion of the housing defining a fluid tight area, coupled to said frame, said side walls including soundproofing elements thereon, said frame including mounting sections therein;

an engine, mounted to one of said mounting sections of said frame, said engine outputting rotary power at a first predetermined revolutions per minute;

an oil-free compressor, mounted to one of said mounting sections of said frame, and requiring rotary power for its operation, said oil-free compressor operating at a second predetermined revolutions per minute which is different than said first predetermined revolutions per minute; and a gearing assembly, coupled between said engine and said compressor, said gearing assembly converting said rotary power from said engine to said rotary power for operation by said compressor, and connected to allow relative movement between said engine and compressor.

16. An assembly as in claim 15 wherein a ratio between said first and second predetermined number of revolutions per minute is 1:1.7.

17. An assembly as in claim 15 wherein said gearing assembly is rigidly coupled to one of said engine and said compressor and is movably coupled to the other of said engine and said compressor.

18. An assembly as in claim 17, wherein said gearing assembly is connected to said frame.

* * * * *